US005898123A

United States Patent [19]

Fritz et al.

[11] Patent Number: 5,898,123

[45] Date of Patent: Apr. 27, 1999

[54] SEALING DEVICE AND A METHOD FOR ASSEMBLY THEREOF

[75] Inventors: James E. Fritz, Ellington; John A. Graham, Middletown; Steven L. Olson, West Hartford; Jon E. Rydberg, Avon, all of Conn.

[73] Assignee: The Ensign-Bickford Company, Simsbury, Conn.

[21] Appl. No.: 08/847,281

[22] Filed: May 1, 1997

[51] Int. Cl.[6] ..... F42B 15/10; B64D 1/04; C06C 5/06

[52] U.S. Cl. ..... 102/378; 89/1.14; 102/275.11

[58] Field of Search ..... 102/378, 377, 102/275.12, 275.11; 89/1.14, 1.57

[56] References Cited

U.S. PATENT DOCUMENTS

| | | | |
|---|---|---|---|
| 3,084,597 | 4/1963 | Beyer . | |
| 3,290,770 | 12/1966 | Silverman et al. . | |
| 3,290,771 | 12/1966 | Silverman et al. . | |
| 3,343,248 | 9/1967 | Silverman et al. . | |
| 3,362,290 | 1/1968 | Carr et al. . | |
| 3,486,410 | 12/1969 | Drexelius et al. . | |
| 3,633,456 | 1/1972 | Carr | 102/378 |
| 3,698,281 | 10/1972 | Brandt et al. . | |
| 4,137,848 | 2/1979 | Cunha . | |
| 4,664,033 | 5/1987 | Burkdoll et al. . | |
| 4,685,376 | 8/1987 | Noel et al. . | |
| 4,879,941 | 11/1989 | Repé et al. . | |
| 5,109,749 | 5/1992 | Olcer . | |
| 5,123,356 | 6/1992 | Brooks et al. . | |
| 5,129,306 | 7/1992 | Fauvel . | |
| 5,147,976 | 9/1992 | Laurensou et al. . | |
| 5,331,894 | 7/1994 | Wassell et al. . | |
| 5,365,851 | 11/1994 | Shaw . | |
| 5,372,071 | 12/1994 | Richards et al. . | |
| 5,390,606 | 2/1995 | Harris . | |
| 5,392,684 | 2/1995 | Renfro et al. . | |
| 5,423,263 | 6/1995 | Rontey et al. . | |

OTHER PUBLICATIONS

Definition of "circumscribe", Webster's new Twentieth Century Dictionary of the English Lnaguage, Unabridged, Second Edition, p. 329, 1983.

Definition of "circumscribe," Webster's II New Riverside University Dictionary, p. 265, 1994 (Month Unknown).

Confined Explosive Separation System; E. Lake; McDonnell Aircraft Company, St. Louis, Missouri, pp. 1–6; Date Unknown.

"Sure–Sep" Separation System; V. Noel; McDonnell Douglas Space Systems Company; MDC H5185; Oct. 1989; pp. 1–5.

AIAA 93–2063; Development and Modeling of a More Efficient Frangible Separation Joint; S. Renfro et al; pp. 1–8; Jun. 1993.

*Primary Examiner*—Charles T. Jordan
*Assistant Examiner*—Theresa M. Wesson
*Attorney, Agent, or Firm*—Law Office of Victor E. Libert; Victor E. Libert; Roger C. Phillips

[57] ABSTRACT

A sealing device (30) is provided for sealing the interior of a pressure vessel such as the containment tube (20) of a separation device (8). The sealing device may comprises a detonation manifold (130, 230 or 330) having a body portion (31) having at least one initiation port (32) for receiving a secondary device such as initiation devices (15*a*, 15*b*) and at least one mounting boss (138 or 238) having an annular locking channel (162 or 262) along the side surface (138*b* or 238*b*) of the mounting boss. A locking collar (150 or 250) having an integral crimping band (158 or 258) which extends along and protrudes from an inner circumferential contact surface (151 or 251) of locking collar (150 or 250).

24 Claims, 7 Drawing Sheets

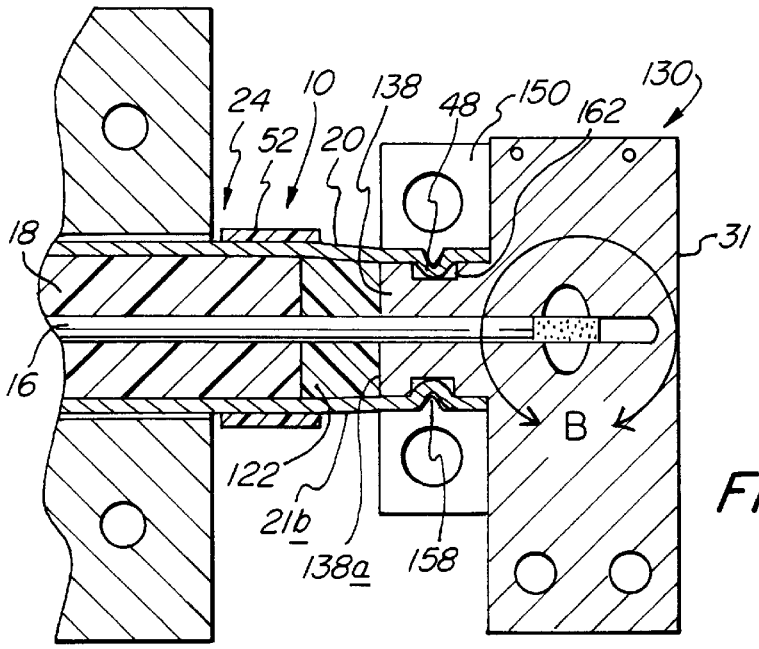
FIG. 5A
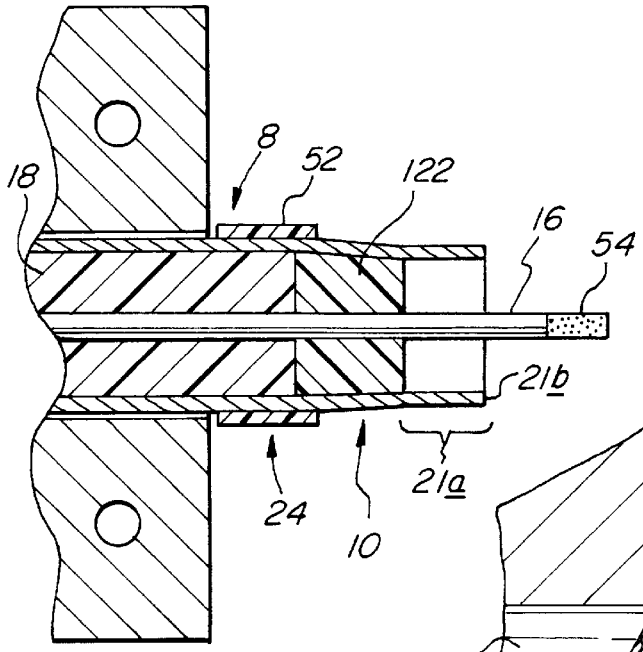
FIG. 5
FIG. 5B
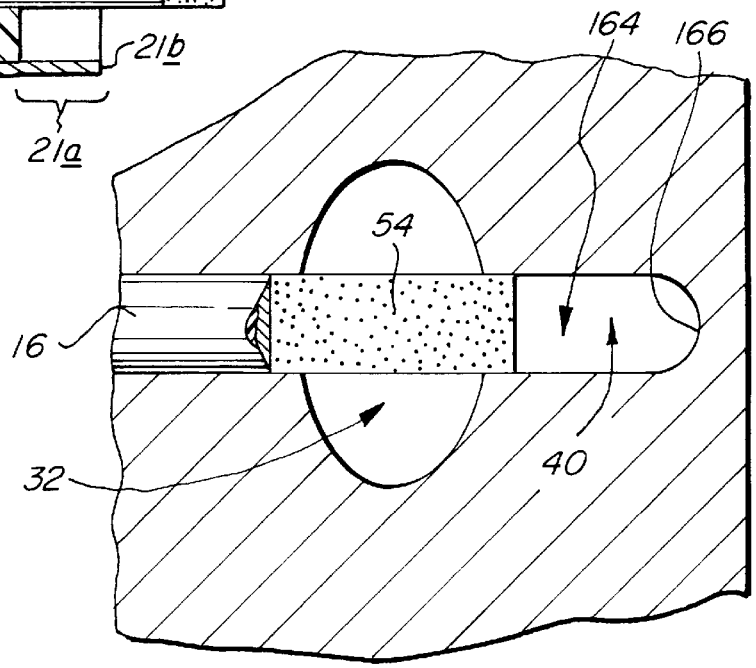

SEALING DEVICE AND A METHOD FOR ASSEMBLY THEREOF

BACKGROUND OF THE INVENTION

1. Field of the Invention

The present invention relates to a sealing device for connecting the interior of a pressure containment vessel to a secondary device, the sealing device being capable of withstanding significant transient shock forces and substantial and sudden increases in internal pressures within the containment vessel. In particular, the sealing device may be used to connect a detonating cord contained in the interior of a containment tube to initiation devices for the detonating cord. Such arrangements are used for separation devices used to connect separable rocket stages, in which the containment tube is disposed within a frangible joint of the separation device.

2. Related Art flanges 38 for receiving the ends of the containment tube and for disposing the detonation charge or fuse of the expansion member in detonation signal communication with the initiation device. The flange 38 also has a bore 40 that communicates with the initiation port. The detonation fuse of the expansion member 10 signal extends into the communication bore 40 in detonation signal transfer relation with the initiation device. The strength of the detonation fuse must be limited to control the pressure resulting from initiation of it in order to maintain the integrity of the containment tube 20 and of the sealing of coupling flanges 38 during detonation of the cord. An increase in the explosive loading of the detonating cord will enhance reliability of the separation device by facilitating the separation of the joined structures, while the need to maintain the integrity of the containment tube during detonation of the cord militates against increasing the explosive loading. Accordingly, a stronger connection of the coupling flanges to the containment tube will enable the use of higher explosive loadings while maintaining integrity of the containment tube.

SUMMARY OF THE INVENTION

Generally, the present invention provides a sealing device for sealing a pressure containment vessel, including providing a sealed connection for connecting a pressure containment vessel to a secondary device. The sealing device is capable of withstanding significant transient shock forces and substantial increases in internal pressures within the pressure containment vessel. In one embodiment of the present invention, the pressure containment vessel comprises the containment tube of a separation device, the containment tube containing a length of detonating cord. Upon initiation of the detonating cord, the containment tube expands, in order to fracture a frangible joint within which it is disposed, but does not itself rupture. The sealing device connects the detonating cord to one or more initiator devices used to detonate the same. Maintaining integrity of the containment tube and of the sealing device(s) attached to it contains the reaction products of the explosion within the containment tube and prevents contamination of the vehicle or other device with which the separation device is associated.

Specifically, in accordance with the present invention, there is provided a sealing device for sealing the interior of a pressure containment vessel, for example, an expandable containment tube, via an opening in the pressure containment vessel, the opening terminating in a tube end defined by a tube wall. The sealing device comprises at least one mounting boss having an end surface and a circumferentially extending side surface and being dimensioned and configured to receive thereon the tube wall in close encircling engagement with the side surface thereof. An annular locking channel having a recessed surface circumscribes the side surface of the mounting boss and is dimensioned and configured to receive therein a displaced portion of such tube wall. A locking collar having a contact surface is dimensioned and configured to be received about the side surface of the mounting boss with such tube wall disposed between the side surface of the mounting boss and the contact surface of the locking collar. The contact surface is coextensive with the locking channel, whereby securing the locking collar about the mounting boss maintains at least a circumferentially extending portion of the tube wall within the locking channel along at least a portion of the circumference of the locking channel.

In accordance with another aspect of the present invention, the sealing device is dimensioned and configured to connect the interior of the pressure containment vessel to a secondary device via the opening in the pressure containment vessel. In this aspect the sealing device comprises a communication bore opening at the end surface of the mounting boss and extending therethrough and into the body portion for communication with the secondary device.

In accordance with another aspect of the present invention, there is provided a sealing device having a detonation manifold for use with a separation device comprising an expansion member. The expansion member is disposed in a frangible joint, having a first joinder flange and a second joinder flange attached to respective opposite sides of the frangible joint. The expansion member comprises a containment tube defined by a tube wall and containing therein a tubular charge holder having a detonating cord disposed therein. The expansion member is dimensioned and configured to fracture the frangible joint upon detonation of the detonating cord. The detonation manifold comprises a body portion having at least one initiation port for receiving an initiation device, at least one mounting boss carried on the body portion, each having an annular locking channel and a locking collar. Each mounting boss has an end surface and a circumferentially extending side surface, and is dimensioned and configured to receive thereon an end of the containment tube for engaging the containment tube in a close encircling engagement with the side surface. The mounting boss has a communication bore for receiving therein a detonating cord. The bore is dimensioned and configured to maintain the fuse received therein in detonation signal communication with the initiation port. The annular locking channel has a recessed surface and circumscribes the side surface of the mounting boss, and is dimensioned and configured to receive a displaced portion of the tube wall. The locking collar has a contact surface which is dimensioned and configured to be received about the side surface of the mounting boss with the tube wall disposed between the side surface of the mounting boss and the contact surface of the locking collar. The contact surface is coextensive with the locking channel whereby securing the locking collar about the mounting boss maintains at least a circumferentially extending portion of the tube wall within the locking channel along at least a portion of the circumference of the locking channel.

In accordance with another aspect of the present invention the sealing device further comprises at least one initiation device mounted in the at least one initiation port in signal transfer communication with the detonating cord.

In accordance with yet another aspect of the present invention, the mounting boss and the tube end each have in cross section a generally oblong configuration having a major axis and a minor axis. The sealing device and the tube are each dimensioned and configured whereby the tube end can be outwardly flared for receiving the sealing device therein while maintaining an oblong configuration of the tube end.

In accordance with another aspect of the present invention, there is provided a locking collar having a circumferential crimping band extending along and protruding from the contact surface and being dimensioned and configured to crimp at least a circumferentially extending portion of the tube wall into the locking channel upon securing the locking collar about the mounting boss.

In accordance with yet another aspect of the present invention the locking collar and its crimping band and the locking channel, are respectively dimensioned and configured to crimp the circumferentially extending portion of such tube wall into substantially full conforming contact with the recessed surface of the locking channel. Optionally, the cross-sectional profile of the crimping band is congruent to the cross-sectional profile of the locking channel.

In accordance with still another aspect of the present invention, the locking channel comprises a pair of diametrically opposed crimp notches, one at each end of the major axis of the mounting boss and a pair of crimp grooves, one extending along each of the surfaces intersected by the minor axis, and wherein the pair of crimp notches are cut deeper into the mounting boss than the pair of crimp grooves.

In accordance with still another aspect of the present invention, the expansion member contains an area of reduced density as compared to that of the tubular charge holder. The area of reduced density is adjacent the end surface of the mounting boss, and optionally, comprises a tubular spacer comprised of a low density material or a narrow diameter tubular spacer for receiving the detonating cord therein.

In accordance with a method aspect of the present invention, there is provided a method for connecting the interior of a pressure containment vessel having an opening which terminates in a tube end defined by a tube wall, to a sealing device . The sealing device has at least one mounting boss carried on a body portion, the mounting boss having a side surface and a recessed annular locking channel having a circumference which circumscribes the side surface. The method comprises placing the tube end over the mounting boss so that the tube end engages the side surface of the mounting boss and then crimping a portion of the tube wall into a portion, but less than all, of the circumference of the locking channel and leaving an uncrimped portion thereof overlying a portion of the locking channel. The tube end is then secured to the mounting boss by affixing a locking collar having a circumferential protruding crimping band extending along and protruding from the contact surface over the tube end. The crimping band is dimensioned and configured to be coextensive with the uncrimped portion of the tube wall. The locking collar is then secured about the tube wall over the mounting boss to crimp at least a circumferentially extending portion of such tube wall into the locking channel.

In another aspect the method may include placing a compliant elastomeric material onto the locking channel prior to engaging the tube end into the mounting boss.

Yet another aspect provides for mounting an 0-ring gasket on the locking channel prior to engaging the tube end onto the mounting boss.

Other aspects of the present invention will become apparent from the following description.

BRIEF DESCRIPTION OF THE DRAWINGS

FIG. 5 is a cross-sectional view of the end of the expansion member of a separation device such as that of FIG. 1A;

FIG. 5A is a partial cross-sectional view of the sealing device of FIG. 3 mounted on the end of the expansion member of FIG. 5;

FIG. 5B is a view enlarged relative to FIG. 5A, of approximately the portion of FIG. 5A within circular arrow B;

DETAILED DESCRIPTION OF THE INVENTION AND PREFERRED EMBODIMENTS THEREOF

Generally, the sealing device of the present invention may be utilized to seal the interior of a pressure vessel with a secondary device via an opening in the pressure vessel which terminates in a tube end comprised of a tube wall. The sealing device of the present invention comprises a mounting boss carried on a body portion, the mounting boss having a recessed locking channel extending circumferentially thereabouts and being dimensioned and configured to be received, with very little clearance, within the opening provided by the tube end. A locking collar is emplaced about the tube wall seated on the mounting boss and extends thereover coextensively with the locking channel of the mounting boss. When tightened, the locking collar cinches the tube wall about the mounting boss, with at least some deformation of the tube wall into the recessed locking channel. Optionally, a communication bore may extend through the mounting boss in order to provide communication between the interior of the pressure vessel and a secondary device. The sealing device of the present invention has broad applicability to such arrangements and is capable of accommodating sudden increases in pressure within the pressure containment vessel, for example, detonation of an explosive within the pressure containment vessel. Embodiments of the sealing device of the present invention are described below in connection with separation devices which find utility in aerospace applications, particularly in the release of rocket stages, the opening of cargo holds, and/or the release of payloads. Although the illustrated embodiments of the present invention are designed specifically for use with separation devices, it will be appreciated that the sealing device of the present invention has other, broader applications for connection to pressure containment vessels generally of any secondary devices, such as pyrotechnic actuators, gas generators, semi-permanent plugs, high pressure sealing devices for non-weldable material, thermocouples, pressure gauges, control sensors or instruments of any type. When the interior of the pressure containment vessel contains an explosive material, the sealing device of the present invention will serve to connect one or more initiators, such as fuses or other detonation signal transmission lines, with the explosive contained within the pressure containment vessel to provide for initiation of the same.

Figure 1A:
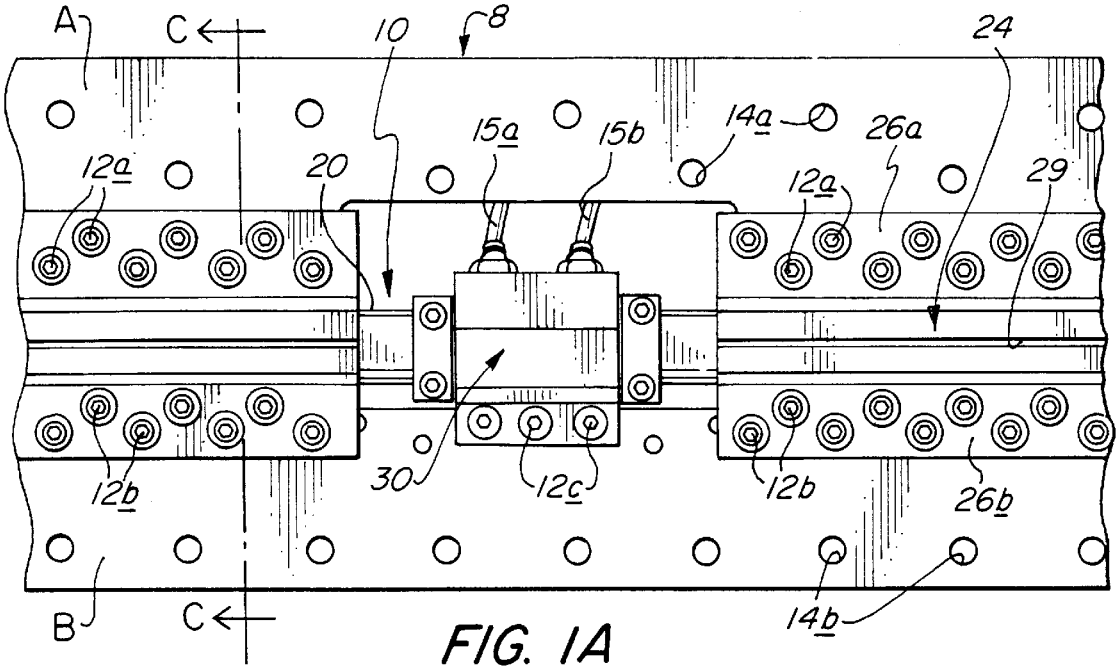
FIG. 1A is a partial front elevation view of a separation device employing a sealing device in accordance with one embodiment of the present invention.
Figure 1B:
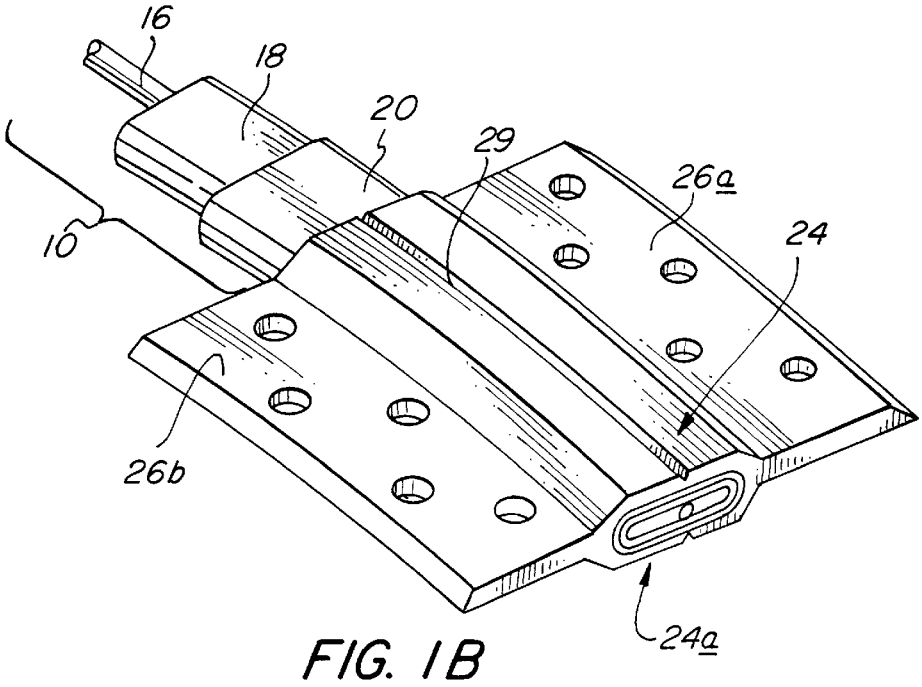
FIG. 1B is a perspective partial view, with parts broken away, of a segment of the separation device of FIG. 1A.
Figure 1D:
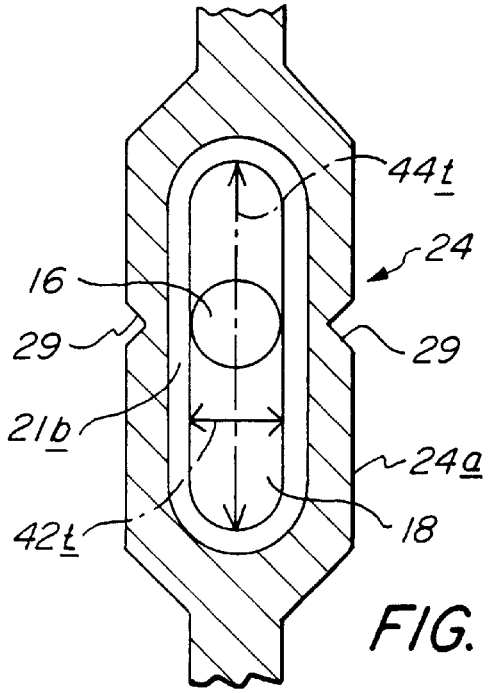
FIG. 1D is a view, enlarged relative to FIG. 1C, of approximately the portion of the FIG. 1C within circular area D.

Thus, the sealing device of the present invention may, in one embodiment, comprise a detonation manifold for coupling the containment tube of a separation device to an initiation device. Typically, such separation devices comprise an expansion member disposed within a frangible joint. As shown in FIG. 1A, a separation device 8 comprises a first joinder flange 26*a* and a second joinder flange 26*b* connected to respective opposite sides of a frangible joint 24. The joinder flanges 26*a* and 26*b* are secured to respective structures, e.g., fairings or field joint adapters on a rocket, missile or payload platform (not shown), that are to be separated at a predetermined time in flight. Fairings A and B are illustrated in FIG. 1A, fairing A being connected by bolts 12*a* to flange 26*a* and fairing B being connected by bolts 12*b* to flange 26*b*. Typically, fairing A might be connected via bolt holes 14*a* to the first stage of a multi-stage rocket and fairing B connected by bolt holes 14*b* to the second stage of a multi-stage rocket, from which the second stage is to be separated in flight. Typically, frangible joint 24 comprises a channel 24*a* (FIG. 1D) within which is disposed an expansion member 10 (FIG. 1B). The frangible joint 24 has a groove 29 (FIGS. 1A and 1B) formed along the entire length of the outer surface of frangible joint 24 to provide a fracture seam. An identical groove 29 (FIG. 1D) is formed on the opposite side of frangible joint 24; both grooves 29 extend continuously along the entire length of frangible joint 24. As seen in FIG. 1B, the expansion member 10 comprises a pressure containment vessel which, in the illustrated embodiment, comprises a deformable containment tube 20 of oblong cross-sectional configuration and within which an elastomeric charge holder 18 supports a detonation charge, typically a mild detonating cord 16. The oblong cross-sectional configuration of containment tube 20 provides it with a major axis illustrated by major axis dimension line 42*t* (FIG. 1D) and a minor axis illustrated by minor axis dimension line 44*t* (FIG. 1D). Charge holder 18 and detonating cord 16, like grooves 29, extend continuously along the entire length of frangible joint 24. Upon detonation of detonating cord 16 the explosive force within containment tube 20 causes the containment tube 20 to expand along its minor axis at the frangible joint 24 along both of the grooves 29 thereof, thus fracturing grooves 29 and thereby permitting the joinder flanges 26*a* and 26*b* and the structures to which they are respectively joined, to separate from one another. The containment tube 20 prevents the release of shrapnel and of chemical by-products of the detonation of the detonating cord 16 in the expansion member 10, thus protecting the structures from damage and confining the detonation by-products.

The detonating cord 16 is initiated by a secondary device which, in the illustrated embodiment, comprises initiator devices comprising signal transmission lines 15*a*, 15*b* (FIG. 1A) which contact detonating cord 16, or an initiator connected thereto, within detonation manifold 30, as described in more detail below. FIG. 1A illustrates an arrangement in which separation device 8, and thus expansion member 10 (and flanges 26*a*, 26*b*) are of circular configuration, as would be the case when separation device 8 is used to connect two rocket stages to each other. In such arrangement, detonation manifold 30 is a double-sided sealing device having at each end a mounting boss (described in more detail below) for securing detonation manifold 30 to each of the opposite tube ends of containment tube 20. For large diameter rockets, separation device 8 might comprise a series of circular segments of expansion member 10, each segment connected to the segments adjacent either side thereof by a detonation manifold 30. Detonation manifold 30 is connected only to fairing B by bolts 12*c* (FIG. 1A). Thus, upon detonation of detonating cord 16, detonation manifold 30 along with joinder flange 26*b* will remain connected to fairing B. In other arrangements, a single-ended detonation manifold may be used.

Figure 1E:
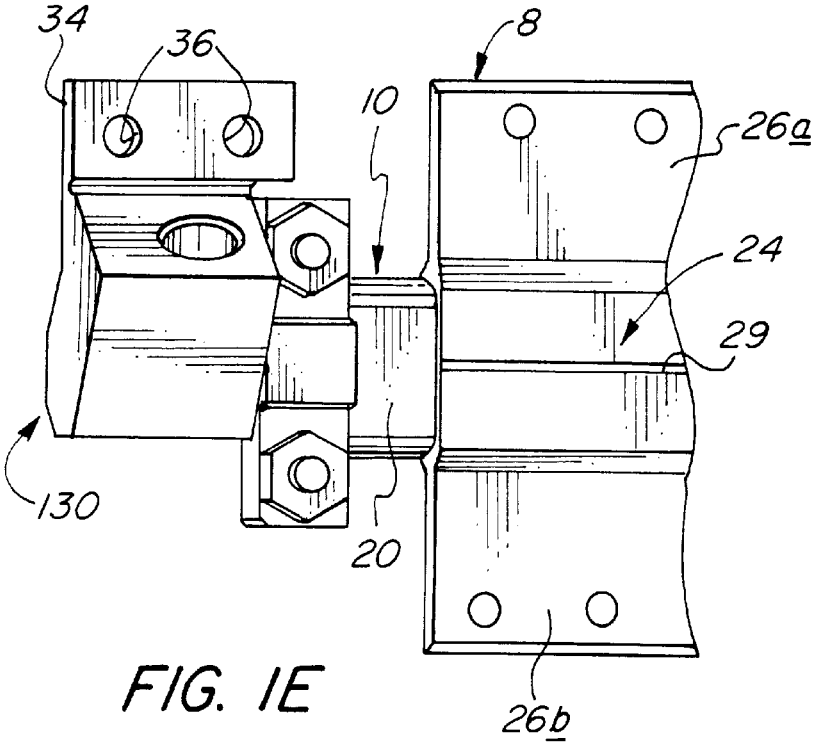
FIG. 1E is a perspective view of a sealing device comprising a detonation manifold in accordance with an embodiment of the present invention mounted on a separation device such as that of FIG. 1B.
Figure 1C:
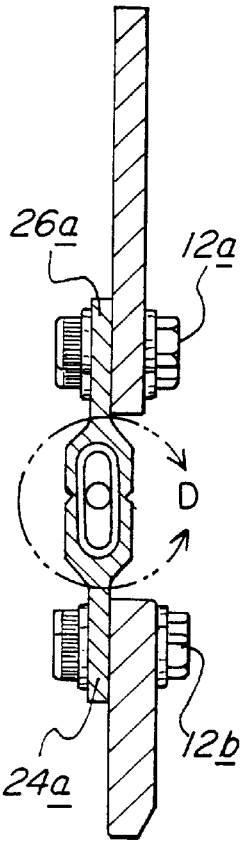
FIG. 1C is a cross-sectional view taken along line C—C of FIG. 1A.

A single-ended detonation manifold 130 is illustrated in FIG. 1E, which shows an end of a separation device 8 secured to a detonation manifold 130 having only one mounting boss. Detonation manifold 130 would be secured via fastening holes 36 of mounting flange 34 to only one of the two structures to be separated, in the same manner as manifold 30 of FIG. 1A is secured to fairing B by bolts 12*c* but not to fairing A.

Figure 2B:
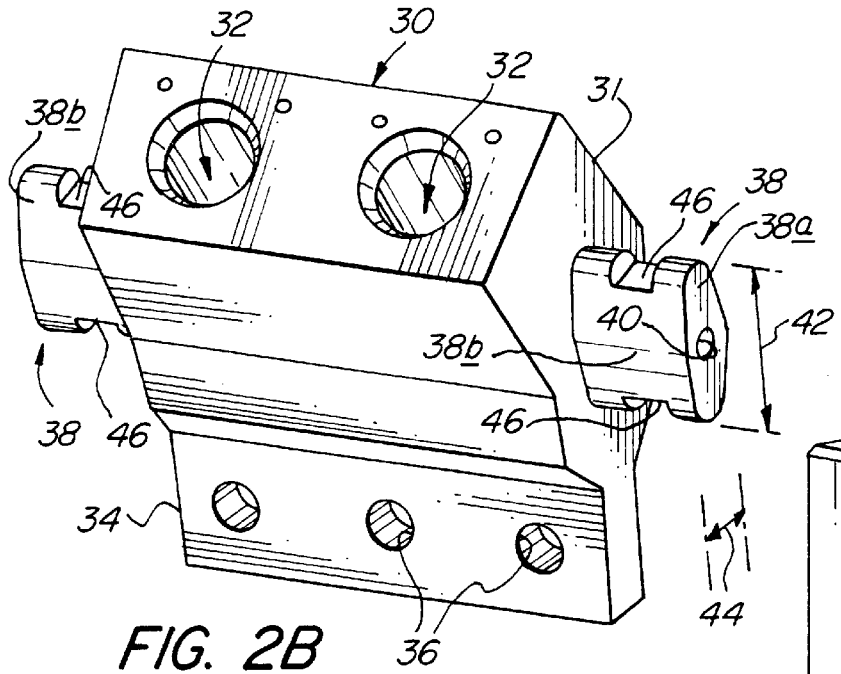
FIG. 2B (PRIOR ART)
FIG. 2B is a perspective view of the prior art detonation manifold of FIG. 2A.
Figure 2C:
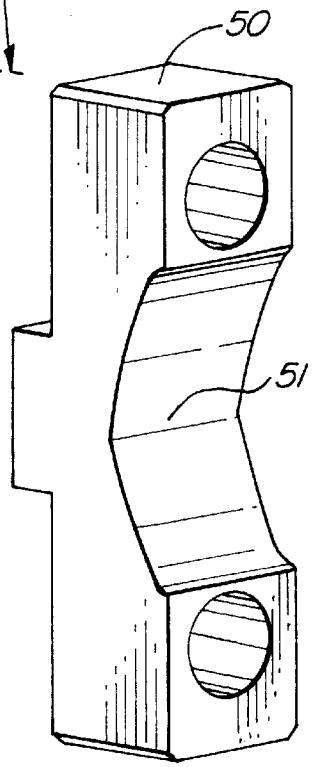
FIG. 2C (PRIOR ART)
FIG. 2C is a perspective view of one-half of the locking collar of the sealing device of FIG. 2A.
Figure 2A:
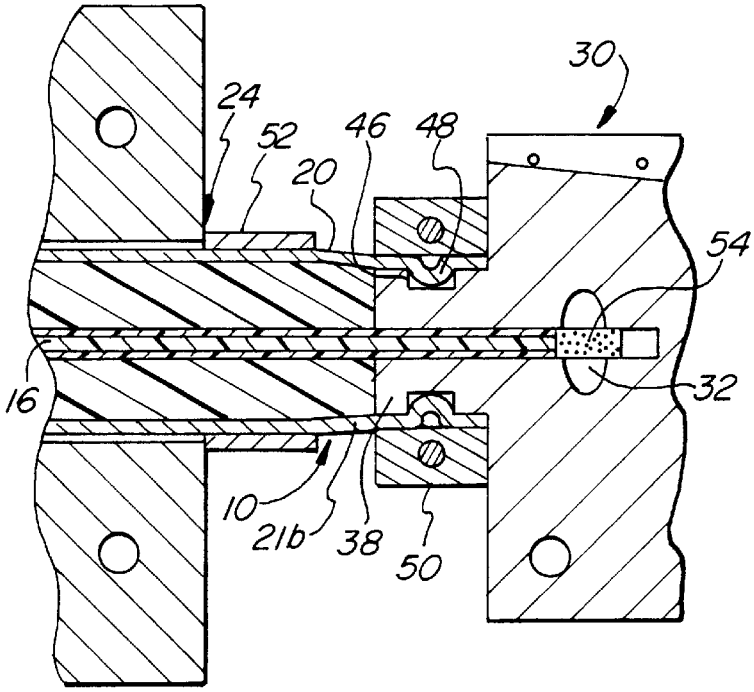
FIG. 2A (PRIOR ART)
FIG. 2A is a partial cross-sectional view of a prior art sealing device mounted on a separation device such as that illustrated in FIG. 1B.
Figure 3:
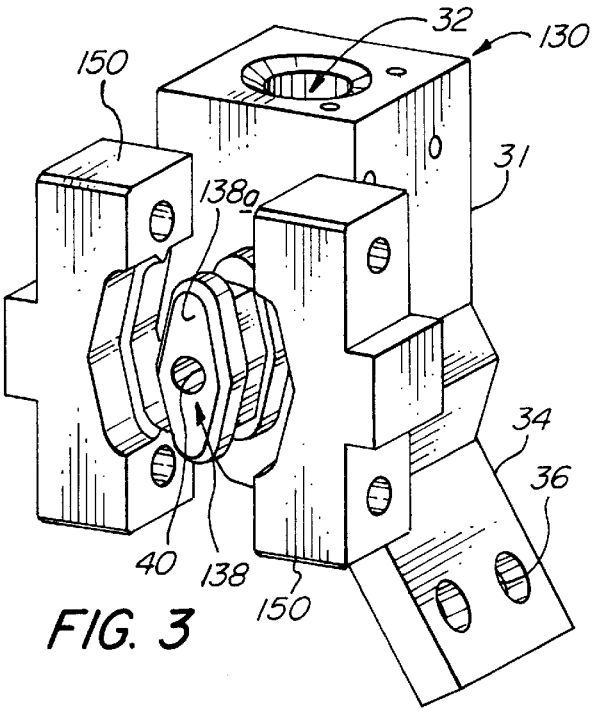
FIG. 3 is an exploded view of a sealing device comprising a detonation manifold according to one embodiment of the present invention.
Figure 3B:
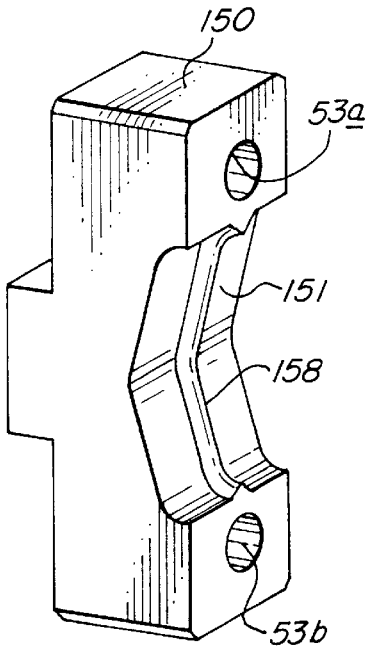
FIG. 3B is a perspective view of one-half of the locking collar of the detonation manifold of FIG. 3.
Figure 3A:
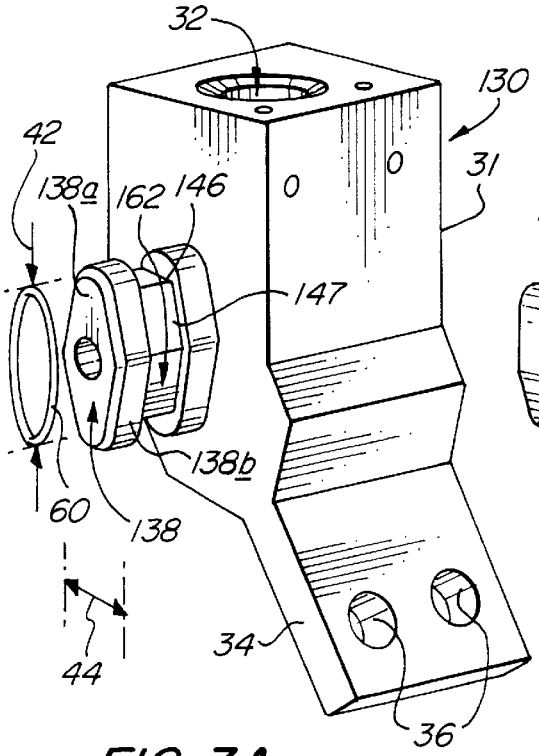
FIG. 3A is a perspective exploded view of the detonation manifold of FIG. 3.
Figure 4:
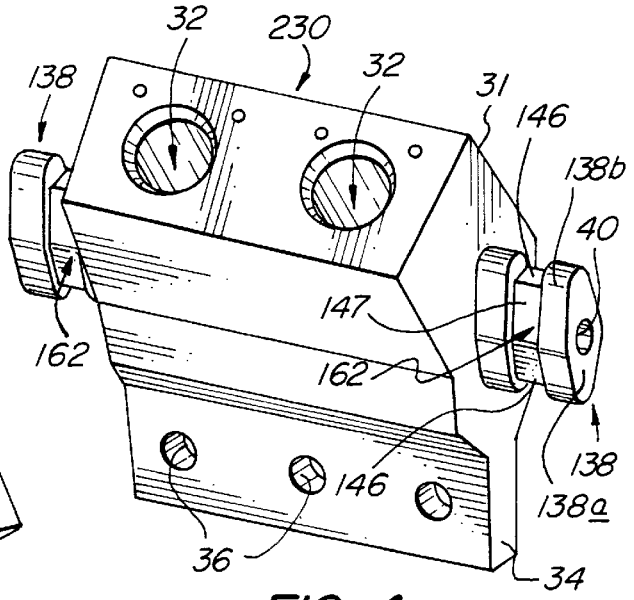
FIG. 4 is a perspective view of a sealing device comprising a double-ended detonation manifold according to another embodiment of the present invention.

The prior art detonation manifold 30, shown in FIGS. 2A and 2B, has parts which are identical and/or functionally equivalent to those of the embodiments of the invention illustrated in FIGS. 3 through 7A. In all the Figures, these identical and/or functionally equivalent parts are identically numbered or numbered with the addition of a prefix number (e.g., 30 in FIG. 1A is 130 in FIG. 1E). Thus, both the prior art detonation manifold 30 (FIG. 2B) and detonation manifold 230 (FIG. 4) include a body portion 31 having initiation ports 32 for respectively receiving a primary initiation device and optionally a redundant initiation device, neither of which is shown in FIGS. 2B and 4 but which are shown as signal transmission lines 15*a*, 15*b* in FIG. 1A. Detonation manifolds 30 and 230 (FIGS. 2B and 4) each include a mounting flange 34 having fastening holes 36 formed therein that allow the manifolds 30 or 230 to be attached to one of the structures which will eventually be separated. Detonation manifold 30 and 230 include a pair of mounting bosses (38 in FIG. 2B, 138 in FIG. 4) having a communication bore 40 therein. Each bore 40 communicates with an initiation port 32, so that a detonating cord 16 (FIGS. 2A and 5A) may be passed therethrough into detonation relation with an initiation device (not shown in FIGS. 2A and 5A) placed in the initiation port 32. Mounting bosses 38 of FIG. 2B and mounting bosses of the present invention 138 and 238 of FIGS. 3A, 4 and 6A, respectively, have in end view, an oblong configuration having a major axis illustrated by dimension line 42 and a minor axis illustrated by dimension line 44.

Figure 6:
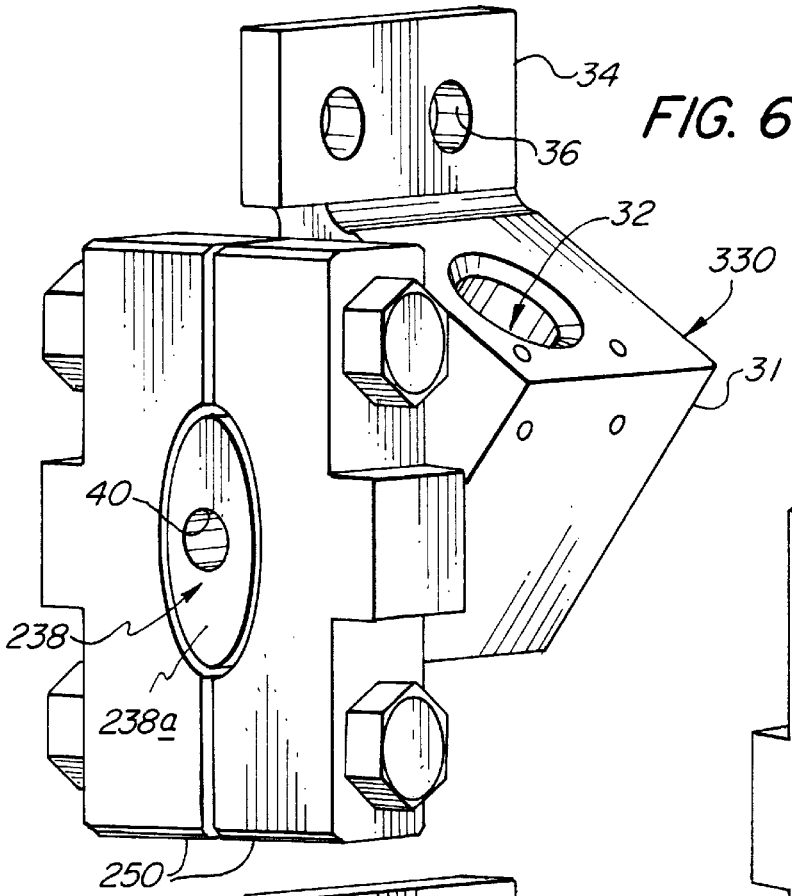
FIG. 6 is a perspective view of a sealing device comprising a detonation manifold in accordance with another embodiment of the present invention, with a locking collar secured thereon but with the tube end to which the sealing device is usually connected omitted for clarity of illustration.
Figure 6B:
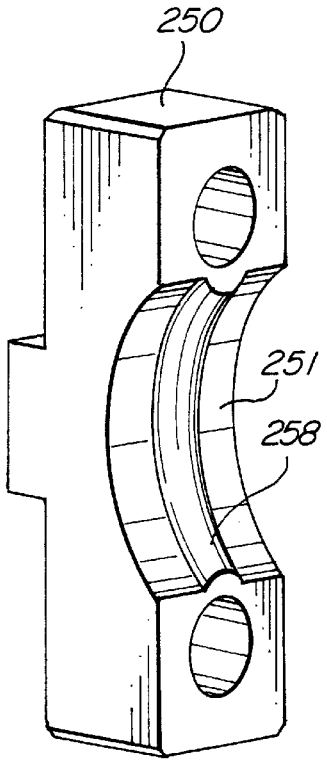
FIG. 6B is a perspective view of one half of the locking collar of the detonation manifold of FIG. 6.
Figure 6A:
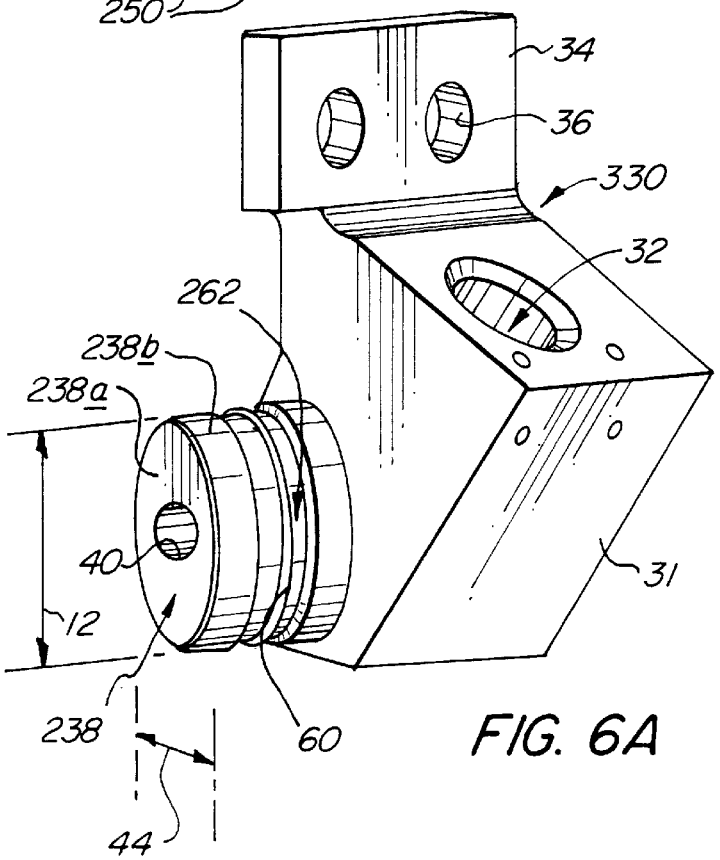
FIG. 6A is a perspective view of the detonation manifold of FIG. 6 with the locking collar removed.

The structures of FIG. 2B on the one hand and FIGS. 3A, 4 and 6A on the other hand, differ from each other essentially with respect to their respective mounting bosses 38 (FIG. 2B) and 138, 238 (FIGS. 3A, 4 and 6A). Mounting bosses 38 of FIG. 2B are equipped with a pair of crimp notches 46 that facilitate the formation of a secure crimp engagement between the tube wall 21b (FIGS. 1D and 2A) of containment tube 20 (FIGS. 1B and 2A) and the detonation manifold 30. Crimp notches 46 are diametrically opposed on the major axis illustrated by dimension line 42 (FIGS. 2B), of mounting boss 38 to facilitate a typical stake-crimp operation.

A two-piece locking collar 50 (one-half of which is shown in FIGS. 2A and 2C) is secured onto mounting boss 38 around the end of the containment tube 20 attached thereon by the formation of a secure crimp engagement of the containment tube 20 into the crimp notches 46. The two-piece locking collar 50 helps to prevent the separation of containment tube 20 from mounting boss 38. As best seen in FIG. 2C, locking collar 50 has a smooth inner circumferential contact surface 51 which is dimensioned and configured to substantially engage onto the outer surface of mounting boss 38, including crimp notches 46, the tube wall 21*b* of containment tube 20 (FIG. 2A), which is disposed between the contact surface 51 of locking collar 50, and the circumferential outer side surface 38*b* (FIG. 2B) of mounting boss 38. Such a locking collar 50 prevents the deformation of containment tube 20 in the localized region of the locking collar 50 and resists axial movement of containment tube 20 with respect to mounting boss 38 when the interior of the containment tube is subjected to significant transient shock forces and substantial increases in internal pressures which result from detonation of detonating cord 16.

As shown in FIGS. 3 through 4 the detonation manifold 130 (FIGS. 3 and 3A) and 230 (FIG. 4) in accordance with an embodiment of the present invention includes at least one mounting boss 138 having an end surface 138*a* and, in addition to a pair of crimp notches 146, a pair of crimp grooves 147 formed on the circumferentially extending side surface 138*b* of the mounting boss 138. The crimp grooves 147 extend to the crimp notches 146 thereby forming a continuous annular, recessed locking channel 162 along the side surface 138*b* of mounting boss 138. In accordance with another embodiment of the present invention as shown in FIG. 4 detonation manifold 230 is double-ended and has a pair of mounting bosses 138, one at each end thereof. As is best seen in FIG. 3B, locking collar 150 has a integral crimping band 158 along the inner circumferential contact surface 151 and a pair of mounting holes 53*a*, 53*b*. The two-piece locking collar 150 of the present invention is secured by suitable mechanical fasteners, e.g., bolt and nut combinations (not shown) passed through mounting holes 53*a*, 53*b* around the mounting boss 138 and the tube end 21*a* (FIG. 5) of containment tube 20 (FIG. 5) surmounting mounting boss 138. When this is done, each crimping band 158 effects a crimp of the tube wall 21*b* of containment tube 20 (FIG. 5A) into respective portions of recessed crimp grooves 147 of locking channel 162. Thus, crimping bands 158 help to effect a thorough and comprehensive crimp in substantially the entire circumferential crimp groove 147 sections of annular locking channel 162.

When fully assembled, the separation device and detonation manifold 130 are joined in the manner illustrated in FIG. 5A. The detonating cord 16 is inserted into the communication bore 40 of mounting boss 138 (see FIGS. 3, 3A and 4) to a point where it passes into initiation port 32 (see FIGS. 5A and 5B). (Initiation port 32 appears in FIG. 5A as being of ovoid configuration even though it is circular in cross section. This is because initiation port 32 is disposed at an oblique angle with respect to the plane of FIG. 5A.) The end of containment tube 20 is dimensioned and configured to pass over mounting boss 138 in close-fitting engagement therewith. An effective crimp may be achieved by stake-crimping the containment tube 20 into the crimp notches 146. A two-piece locking collar 150, as best seen in FIG. 3B, having an inner circumferential protruding crimping band 158 along the entire inner circumferential contact surface, is dimensioned and configured to crimp the containment tube 20 into the remaining portions of locking channel 162 (i.e., crimp grooves 147) of mounting boss 138. Specifically, the protruding crimping band 158 will effect a crimp of the containment tube 20 along the crimp groove 147 sections of locking channel 162 as the two-piece collar is tightened together. Crimping bands 158 also maintain an effective seal between containment tube 20 and mounting boss 138 by ensuring the integrity of the stake-crimp of containment tube 20 into the crimp notches 46 and the crimp of containment tube 20 into crimp grooves 147. That is, crimping bands 158 hold the crimped portion of containment tube 20 within the locking channel 162 thereby preventing the crimp from backing away from locking channel 162 in the presence of substantial forces and pressures due to the detonation of detonating cord 16. Preferably, crimping band 158 is dimensioned and configured to have in cross section a triangular configuration (FIG. 3B).

Optionally, before mounting boss 138 is received within tube end 21*a* of containment tube 20, the respective structures are treated with a sealant (not shown) such as a room temperature vulcanizing (RTV) rubber (for example, RTV 88 manufactured by the General Electric Company) to better seal any voids that may remain after crimping containment tube 20 into locking channel 162. An O-ring gasket 60 (FIG. 3A) may be mounted within annular locking channel 162 of mounting boss 138 to prevent the sealant from seeping into the interior of the containment tube 20 while the sealant is curing.

To facilitate joinder of expansion member 10 to detonation manifold 130, expansion member 10 is extended outwardly of separation device 8 is seen in FIG. 5, and portion of elastomeric charge holder 18 is removed from the end of containment tube 20. A tubular spacer 122 comprised of a low density material such as a foamed plastic material may be inserted within containment tube 20 (see FIGS. 5 and 5A) between the end of charge holder 18 and the end surface 138*a* of mounting boss 138 (FIG. 5A). Such a tubular spacer 122 helps to maintain the integrity of the joint between the containment tube 20 and the mounting boss 138 by providing a limited region of low density material which can attenuate at least some of the pressure resulting from the detonation of the detonating cord 16. Optionally, as seen in FIGS. 5A and 5B, bore 40 may be extended within detonation manifold 130 past initiation port 32 to provide a region of free volume 164 which is also used to attenuate the pressure resulting from the detonation of the detonating cord 16. Preferably, the region of free volume 164 terminates in a hemispherical shape 166. Before detonating cord 16 is inserted into communication bore 40 of mounting boss 138, a booster cap 54 (FIG. 5) is attached to its end. Such a booster cap may comprise, e.g., a charge of about 96 mg of an HNS-IA explosive. Preferably, containment tube 20 has, in cross section, an oblong configuration defining major and minor axes (illustrated by dimension lines 42*t* and 44*t*, respectively, of FIG. 1D) corresponding to the oblong configuration of mounting boss 138 (illustrated by dimension lines 42 and 44, respectively, of FIG. 3A). Further, the portion of containment tube 20 which is to receive mounting boss 138 may be slightly flared outwardly from its initial oblong configuration producing a slight reduction in its length along its major axis to enable the end of containment tube 20 to fit in close encircling engagement with mounting boss 138. Although it is generally not necessary to do so, it is preferred to provide reinforcement of the exposed portion of containment tube 20 by placing a reinforcement ring 52 (FIGS. 5 and 6) thereon before engaging containment tube 20 of expansion member 10 with detonation manifold 130.

Figure 7A:
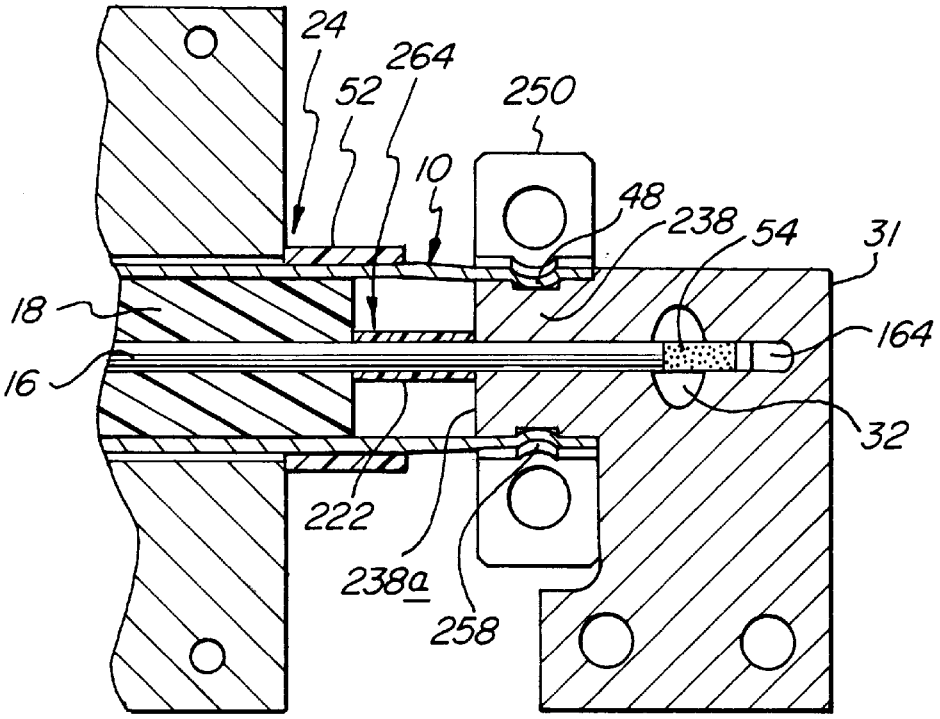
FIG. 7A is a partial cross-sectional view of the detonation manifold of FIG. 6 mounted on the end of the expansion member of FIG. 7.

The detonation manifold 330 in accordance with another embodiment of the present invention (FIGS. 6 through 7A) has a mounting boss 238 dimensioned and configured as having an oval cross section having a smooth continuous annular locking channel 262 along the outer surface thereof. In a preferred embodiment shown in FIGS. 6A and 7A, the locking channel 262 of mounting boss 238 is dimensioned and configured to have in cross section a uniform curved surface and crimping band 258 (FIG. 6B) of locking collar 250 is dimensioned and configured to have in cross section a uniform mating curved surface. Crimping band 258 is dimensioned and configured such that when the locking collar 250 is secured around containment tube 20 a fully compliant crimp of the tube wall 21*b* into locking channel 262 is produced (FIG. 7A). That is, the tube wall 21*b* is fully coexistent with locking channel 262 without voids within the locking channel 262 around the crimped portion of the tube wall. A small diameter tubular spacer 222, which does not occupy the entire space vacated by the removed portion of the charge holder 18, may be placed within containment tube 20 (see FIGS. 7 and 7A) between the end of charge holder 18 and the end surface 238*a* of mounting boss 238. Similarly, such a spacer 222 helps to maintain the integrity of the joint between the containment tube 20 and the mounting boss 238 by providing a region of free volume 264 which can attenuate at least some of the pressure resulting from the detonation of the detonating cord 16.

Figure 8:
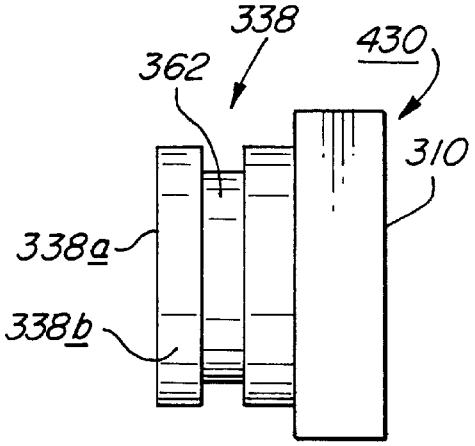
FIG. 8 is a side view of a sealing device in accordance with another embodiment of the present invention.
Figure 7:
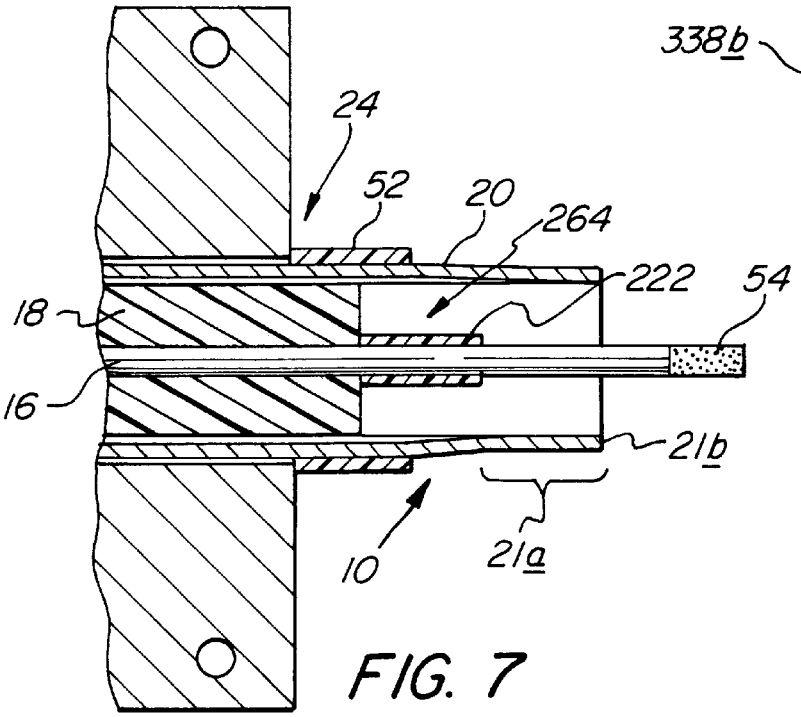
FIG. 7 is a cross-sectional view of the end of the expansion member of a separation device such as that of FIG. 1A but showing a different construction from that of the expansion member of FIG. 5.

FIG. 8 illustrates an embodiment of the present invention in which the sealing device 430 closes, i.e., seals off, the interior of the pressure containment vessel instead of sealingly connecting the interior to a secondary device as is the case with the other illustrated embodiments. Accordingly, sealing device 430 has a mounting boss 338 mounted on a body portion 310. As in the other illustrated embodiments, mounting boss 338 has a side surface 338*b* in which is formed a circumferentially extending locking channel 362, and an end surface 338*a*. However, in this embodiment, sealing device 430 does not contain a communication bore, such as communication bore 40 (e.g., FIGS. 3, 4 and 6A) of the other illustrated embodiments, or equivalent structure. Instead, mounting boss 338 and body portion 310 are of unapertured, imperforate construction. Sealing device 430 is secured to an opening in a pressure containment vessel in a manner identical to that of the other illustrated embodiments. Thus, mounting boss 338 is received in a tube end such as tube end 21*a* of containment tube 20 (FIG. 5) and tube wall 21*b* is crimped into locking channel 362 by crimping band such as crimping band 158 (FIG. 3B) as locking collar 150 (FIG. 3B) is secured around tube wall 21*b* and mounting boss 338 received therein. With sealing device 430 thus mounted in place, tube end 21*a* is closed off by a high-pressure resistant seal.

In a particular embodiment, the containment tube 20 may be formed from a tube that was originally circular in cross-sectional configuration with a 0.625 inch (15.8 mm) outer diameter and 0.049 inch (1.2 mm) wall thickness, and made from a resilient material such as stainless steel type 304 or 304L tubing that meets specification number MIL-T-8504 OR 8606. The circular tube may be flattened to have a major axis (illustrated by dimension line 42*t* of FIG. 1D) of about 0.80 inches (20.574 mm) and a minor axis (illustrated by dimension line 44*t* of FIGS. 1D) of about 0.30 inches. An appropriately configured mounting boss 138 or 238 may have a cross-sectional configuration having a major axis (illustrated by dimension line 42 of FIGS. 3A and 6A) respectively of approximately 0.67 inches (7.02 mm) and a minor axis (illustrated by dimension line 44, of FIGS. 3A and 6A, respectively ) of about 0.31 inches (7.87 mm). The crimp notches 146 and crimp grooves 147 (FIG. 3A) of one embodiment of the present invention are cut 0.10 inches (2.54 mm) and 0.020 inches (0.51 mm) deep, respectively, into mounting boss 138. In an alternate embodiment of the present invention as seen in FIG. 6A, annular locking channel 262 is a uniform channel cut 0.020 inches (0.51 mm) deep. In either embodiment the communication bore 40 may have a diameter of about 0.15 inches (3.8 mm) and may extend about 1.3 inches (33.2 mm) into the detonation manifold. The mounting boss 138 or 238 may extend about 0.5 inches (12.7 mm) from the side of the body portion 31 of the detonation manifold 130, 230 or 330, respectively, so that the communication bore 40 extends about 0.8 inches (20.32 mm) into the body portion, passing through an initiation port 32 in the body portion 31. The center of the associated initiation port 32 may be about 0.375 inches (9.52 mm) from the side of the body portion 31. The tube end 21*a* of the containment tube 20 may then be flared or swaged slightly to have a minor interior axis of about 0.31 inches (7.87 mm) and a major interior axis of about 0.67 inches (17.02 mm). Thus, the tube is only slightly flared but nonetheless is configured for a close fit on the mounting boss 138 or 238.

When the detonating cord 16 is fully inserted into the communication bore 40 (FIGS. 5A and 7A), an initiation device inserted into the initiation port 32 is disposed in detonation relation with detonating cord 16, at right angles thereto. The typical initiation device may be a flexible confined detonating cord (FCDC) having a cup on the end loaded with an HNS-IA charge or a hot bridge wire detonator or a laser initiated detonator. To effect separation of the initiation device, the FCDC is detonated, and the HNS-IA loaded cup detonates booster cap 54 on the detonating cord 16 of the expansion member 10. Preferably, detonation manifold 130, 230 or 330 is dimensioned and configured to fully contain these detonation reactions, i.e., to inhibit the release therefrom of shrapnel or other detonation by-products. The detonation of detonating fuse 16 causes the flattened containment tube 20 to expand, fracturing the frangible joint 24 and thus separating joinder flanges 26*a*, 26*b* and the associated fairings.

While the invention has been described in detail with respect to numerous embodiments thereof, it will be apparent that upon a reading and understanding of the foregoing, numerous alterations to the described embodiment will occur to those skilled in the art and it is intended to include such alterations within the scope of the appended claims.

What is claimed is:

1. A sealing device for sealing the interior of a pressure containment vessel via an opening in the pressure containment vessel, the opening terminating in a containment tube including a tube end defined by a tube wall, and the sealing device comprising:

(a) at least one mounting boss carried on a body portion, the mounting boss having an end surface and a circumferentially extending side surface, the mounting boss being dimensioned and configured to receive thereon the tube wall in close encircling engagement with the side surface thereof;

(b) an annular locking channel having a recessed surface and circumscribing the side surface of the mounting boss, the locking channel being dimensioned and configured to receive therein a displaced portion of such tube wall; and (c) a locking collar having a contact surface dimensioned and configured to be disposed about the side surface of the mounting boss with such tube wall disposed between the side surface of the mounting boss and the contact surface of the locking collar, the contact surface being coextensive with the locking channel whereby securing the locking collar about the mounting boss with such tube wall disposed therebetween maintains at least a circumferentially extending portion of such tube wall within the locking channel along at least a portion of the circumference of the locking channel.

2. The sealing device of claim 1 dimensioned and configured to connect the interior of the pressure containment vessel to a secondary device via the opening in the pressure containment vessel, and further comprising a communication bore opening at the end surface of the mounting boss and extending therethrough and into the body portion for communication with such secondary device.

3. A sealing device comprising a detonation manifold for use with a separation device comprising an expansion member disposed in a frangible joint having a first joinder flange and a second joinder flange attached to respective opposite sides thereof, the joinder flanges having thereon means for securing each joinder flange to a respective one of two structures to be temporarily joined to one another by the separation device, the expansion member comprising a containment tube defined by a tube wall and containing therein a tubular charge holder retaining a detonating cord within the containment tube, the containment tube being dimensioned and configured to expand upon detonation of the detonating cord to fracture the frangible joint, the manifold comprising:

(a) a body portion having at least one initiation port for receiving an initiation device;

(b) at least one mounting boss carried on the body portion, each mounting boss having an end surface and a circumferentially extending side surface, and being dimensioned and configured to receive thereon an end of the containment tube for engaging the containment tube in a close encircling engagement with the side surface thereof, the mounting boss having a communication bore for receiving therein the detonating cord, the bore being dimensioned and configured to maintain the detonating cord received therein in detonation signal communication with the initiation port;

(c) an annular locking channel having a recessed surface and circumscribing the side surface of the mounting boss, the locking channel being dimensioned and configured to receive therein a displaced portion of such tube wall; and (d) a locking collar having a contact surface dimensioned and configured to be disposed about the side surface of the mounting boss with such tube wall disposed between the side surface of the mounting boss and the contact surface of the locking collar, the contact surface being coextensive with the locking channel whereby securing the locking collar about the mounting boss with such tube wall disposed therebetween maintains at least a circumferentially extending portion of such tube wall within the locking channel along at least a portion of the circumference of the locking channel.

4. The sealing device of claim 3 further comprising at least one initiation device mounted in the at least one initiation port in signal transfer communication with the detonating cord.

5. The sealing device of claim 1, claim 2 or claim 3 comprising at least another one of the mounting bosses whereto another tube end of such containment tube is connectable therewith.

6. The sealing device of claim 1, claim 2 or claim 3 wherein the mounting boss and the containment tube have in cross section a generally oblong configuration having a major axis and a minor axis.

7. The sealing device of claim 6 wherein the mounting boss and the containment tube are each dimensioned and configured whereby when the tube end is outwardly flared, the tube end retains an oblong configuration for receiving the mounting boss therein.

8. A combination of the sealing device of claim 2 with such pressure containment vessel and such secondary device, wherein the mounting boss and the tube end each have in cross section a generally oblong configuration having a major axis and a minor axis.

9. The combination of claim 8 wherein the mounting boss and the containment tube are each dimensioned and configured whereby when the tube end is outwardly flared, the tube end retains an oblong configuration for receiving the mounting boss therein.

10. The combination of claim 8 wherein the pressure containment vessel comprises an expandable containment tube which is of oblong configuration in cross-sectional profile, having a minor axis and a major axis, the containment tube being disposed within a frangible joint of a separation device comprising a first joinder flange and a second joinder flange attached to opposite sides of the frangible joint, a detonating cord disposed within the containment tube and being of sufficient explosive power such that initiation of the detonating cord expands the containment tube along the minor axis thereof sufficiently to fracture the frangible joint and thereby separate the first flange from the second flange, the containment tube terminating in the tube end and the communication bore communicating with a receptacle for receiving a secondary device comprising an initiation device for the detonating cord.

11. The sealing device of claim 6 wherein the locking channel comprises a pair of diametrically opposed crimp notches, one at each end of the major axis of the mounting boss and a pair of diametrically opposed crimp grooves, one at each end of the minor axis of the mounting boss and each crimp groove communicating with each crimp notch, and wherein the pair of crimp notches are cut deeper into the mounting boss than the pair of crimp grooves.

12. The sealing device of claim 3 wherein the expansion member contains an area of reduced density as compared to that of the tubular charge holder, the area of reduced density being adjacent the end surface of the mounting boss.

13. The sealing device of claim 12 wherein the area of reduced density comprises a tubular spacer comprised of a low density material.

14. The sealing device of claim 12 wherein the area of reduced density comprises a narrow diameter tubular spacer for receiving the detonating cord therein.

15. A sealing device for sealing the interior of a pressure containment vessel via an opening in the pressure containment vessel, the opening terminating in a containment tube including a tube end defined by a tube wall, and the seating device comprising:

(a) at least one mounting boss carried on a body portion, the mounting boss having an end surface and a circumferentially extending side surface the mounting boss being dimensioned and configured to receive thereon the tube wall in close encircling engagement with the side surface thereof;

(b) an annular locking channel having a recessed surface and circumscribing the side surface of the mounting boss, the locking channel being dimensioned and configured to receive therein a displaced portion of such tube wall; and (c) a locking collar having a contact surface dimensioned and configured to be disposed about the side surface of the mounting boss with such tube wall disposed between the side surface of the mounting boss and the contact surface of the locking collar, the contact surface being coextensive with the locking channel whereby securing the locking collar about the mounting boss with such tube wall disposed therebetween maintains at least a circumferentially extending portion of such tube wall within the locking channel along at least a portion of the circumference of the locking channel; and wherein the locking collar has a circumferential crimping band extending along and protruding from the contact surface and dimensioned and configured to crimp at least a circumferentially extending portion of such tube wall into the locking channel upon securing the locking collar about the mounting boss with such tube wall disposed therebetween.

16. The sealing device of claim 15 wherein (a) the locking collar and the crimping band and (b) the locking channel, are respectively dimensioned and configured to crimp the circumferentially extending portion of such tube wall into substantially full conforming contact with the recessed surface of the locking channel.

17. The sealing device of claim 16 wherein the cross-sectional profile of the crimping band is congruent to the cross-sectional profile of the locking channel.

18. The sealing device of claim 15 further comprising a compliant elastomeric material disposed within the locking channel for interposition between such tube wall and the locking channel.

19. The sealing device of claim 18 wherein the compliant elastomeric material comprises a room temperature vulcanizing rubber.

20. The sealing device of claim 15 further comprising an O-ring gasket disposed within the locking channel for interposition between such tube wall and the locking channel.

21. A sealing device comprising a detonation manifold for use with a separation device comprising an expansion member disposed in a frangible joint having a first joinder flange and a second joinder flange attached to respective opposite sides thereof, the joinder flanges having thereon means for securing each joinder flange to a respective one of two structures to be temporarily joined to one another by the separation device, the expansion member comprising a containment tube defined by a tube wall and containing therein a tubular charge holder retaining a detonating cord within the containment tube, the containment tube being dimensioned and configured to expand upon detonation of the detonating cord to fracture the frangible joint, the manifold comprising:

(a) a body portion having at least one initiation port for receiving an initiation device;

(b) at least one mounting boss carried on the body portion, each mounting boss having an end surface and a circumferentially extending side surface, and being dimensioned and configured to receive thereon an end of the containment tube for engaging the containment tube in a close encircling engagement with the side surface thereof, the mounting boss having a communication bore for receiving therein the detonating cord, the bore being dimensioned and configured to maintain the detonating cord received therein in detonation signal communication with the initiation port;

(c) an annular locking channel having a recessed surface and circumscribing the side surface of the mounting boss, the locking channel being dimensioned and configured to receive therein a displaced portion of such tube wall; and (d) a locking collar having a contact surface dimensioned and configured to be disposed about the side surface of the mounting boss with such tube wall disposed between the side surface of the mounting boss and the contact surface of the locking collar, the contact surface being coextensive with the locking channel whereby securing the locking collar about the mounting boss with such tube wall disposed therebetween maintains at least a circumferentially extending portion of such tube wall within the locking channel along at least a portion of the circumference of the locking channel; and wherein the communication bore continues past the initiation port to provide a region of free volume which terminates in a hemispherical surface.

22. A method for connecting the interior of a pressure containment vessel having an opening which terminates in a tube end defined by a tube wall, to a sealing device, the sealing device having at least one mounting boss carried on a body portion, the mounting boss having a side surface and a recessed annular locking channel having a circumference which circumscribes the side surface of the mounting boss, the method comprising:

(a) placing the tube end over the mounting boss, so that the tube end closely engages the side surface of the mounting boss and then crimping a portion of the tube wall into a portion, of the circumference of the locking channel leaving an uncrimped portion thereof overlying a portion of the locking channel; and (b) securing the tube end to the mounting boss by affixing a locking collar over the tube end around the mounting boss, the locking collar having a contact surface having a circumferential protruding crimping band extending along and protruding from the contact surface and dimensioned and configured to be coextensive with the uncrimped portion of the tube wall and securing the locking collar about the tube wall over the mounting boss to crimp at least a circumferentially extending portion of such tube wall into the locking channel.

23. The method of claim 22 further comprising placing a compliant elastomeric material into the locking channel prior to engaging the tube end onto the mounting boss.

24. A method for connecting the interior of a pressure containment vessel having an opening which terminates in a tube end defined by a tube wall, to a sealing device, the sealing device having at least one mounting boss carried on a body portion, the mounting boss having a side surface and a recessed annular locking channel having a circumference which circumscribes the side surface of the mounting boss, the method comprising:

(a) placing the tube end over the mounting boss, so that the tube end closely engages the side surface of the mounting boss and then crimping a portion of the tube wall into a portion of the circumference of the locking channel leaving an uncrimped portion thereof overlying a portion of the locking channel;

(b) securing the tube end to the mounting boss by affixing a locking collar over the tube end around the mounting boss, the locking collar having a contact surface having a circumferential protruding crimping band extending along and protruding from the contact surface and dimensioned and configured to be coextensive with the uncrimped portion of the tube wall and securing the locking collar about the tube wall over the mounting boss to crimp at least a circumferentially extending portion of such tube wall into the locking channel; and (c sealing the tube end onto the mounting boss by mounting an O-ring gasket on the locking channel prior to engaging the tube end onto the mounting boss.

* * * * *

UNITED STATES PATENT AND TRADEMARK OFFICE

CERTIFICATE OF CORRECTION

PATENT NO. : 5,898,123
DATED : April 27, 1999
INVENTOR(S) : Fritz et al.

It is certified that error appears in the above-identified patent and that said Letters Patent is hereby corrected as shown below:

Title page,
Item [57], ABSTRACT
Line 3, after "May" delete "comprises" and insert therefor -- comprise --

Column 1,
Line 20, after "Art", insert therefor -- U.S. Patent 5,331,894 to Wassell et al, dated July 26, 1994 ("the '894 Patent"), discloses a separation device comprising an expansion member 10, which comprises a containment tube 20 (Figure 5) and a detonation manifold 30 having a pair of coupling flanges 38, each of which has a pair of diametrically opposed crimp notches 46 (Figure 2). The containment tube 20 is stake-crimped onto the coupling flange 38 at the crimp notches 46 to attach the containment tube to thereon. Such a stake-crimp comprises at least one "point contact" to effect a seal between the containment tube and the mounting boss but may not extend over the entire crimping area. It is also know to effect a crimp which extends over the entire area by employing a roll-crimp process. Such a roll-crimp process may involve effective a crimp by rolling the crimp head about the containment tube. Retaining bands are used to secure the crimps against being breached upon detonation.

As shown in the '894 Patent, it is also know in the art to join an expansion member 10 to an initiation device through the use of a detonation manifold 30. The manifold has iinitiation ports 32 within which an initiation device is disposed and has --.

Column 7,
Line 26, after "42" delete "(FIGS." and insert therefor -- (FIG. --
Line 63, after "has" delete "a" and insert therefor -- an --

UNITED STATES PATENT AND TRADEMARK OFFICE

CERTIFICATE OF CORRECTION

PATENT NO. : 5,898,123
DATED : April 27, 1999
INVENTOR(S) : Fritz et al.

It is certified that error appears in the above-identified patent and that said Letters Patent is hereby corrected as shown below:

Column 8,
Line 3, after "20" delete "(FIG.5)" and insert therefor -- (FIG. 5A) --
Line 58, after "8" delete "is" and insert therefor -- as --
Line 58, after "and", insert therefor -- a --

Column 10,
Line 22, after "of" (second occurrence) delete "FIGS." and insert therefor -- FIG. --
Line 66, after "detonating" delete "fuse" and insert therefor -- fuse --

Column 11,
Line 6, after "described" delete "embodiment" and insert therfor -- 13 --

Comun 13,
Line 12, after "claim" delete "12" and insert therefor -- 13 --
Line 18, after "the", delete "seating" and insert therefor -- sealing --
Line 22, after "surface" insert therefor -- , --

Column 14,
Line 59, after "portion" delete ","

Column 16,
Line 14, before "sealing" delete "(c" and insert therfor -- ( c ) --

Signed and Sealed this

Twenty-ninth Day of June, 2004

JON W. DUDAS
*Acting Director of the United States Patent and Trademark Office*